United States Patent [19]

Hattori et al.

[11] 4,410,378

[45] Oct. 18, 1983

[54] METHOD OF PRODUCING WATER-IN-OIL EMULSION EXPLOSIVE

[75] Inventors: Katsuhide Hattori; Yoshiaki Fukatsu; Shigeru Kakino, all of Chita; Hideo Moriyama, Tokoname; Hidekazu Sakakibara, Handa, all of Japan

[73] Assignee: Nippon Oil and Fats Co. Ltd., Tokyo, Japan

[21] Appl. No.: 460,402

[22] Filed: Jan. 21, 1983

[30] Foreign Application Priority Data

Jan. 27, 1982 [JP] Japan ..... 57-10194

[51] Int. Cl.[3] ..... C06B 45/00

[52] U.S. Cl. ..... 149/109.6; 149/2; 149/21; 149/46; 149/60; 264/3 R; 264/3 C

[58] Field of Search ..... 149/109.6, 2, 21, 46, 149/60; 264/3 R, 3 C

[56] References Cited

U.S. PATENT DOCUMENTS

| | | | |
|---|---|---|---|
| 3,765,964 | 10/1973 | Wade | 149/2 |
| 4,110,134 | 8/1978 | Wade | 149/2 |
| 4,111,727 | 9/1978 | Clay | 149/2 |
| 4,141,767 | 2/1979 | Sudweeks et al. | 149/2 |
| 4,218,272 | 8/1980 | Brockington | 149/2 |
| 4,231,821 | 11/1980 | Sudweeks et al. | 149/2 |
| 4,310,364 | 1/1982 | Ekman et al. | 149/2 |
| 4,315,784 | 2/1982 | Hattori et al. | 149/2 |
| 4,315,787 | 2/1982 | Hattori et al. | 149/2 |
| 4,322,258 | 3/1982 | Sudweeks et al. | 149/2 |
| 4,326,900 | 4/1982 | Hattori et al. | 149/2 |
| 4,356,044 | 10/1982 | Jessop et al. | 149/2 |
| 4,357,184 | 11/1982 | Binet et al. | 149/2 |
| 4,371,408 | 2/1983 | Fillman | 149/2 |

*Primary Examiner*—Stephen J. Lechert, Jr.
*Attorney, Agent, or Firm*—Parkhurst & Oliff

[57] ABSTRACT

A method of producing water-in-oil emulsion explosive by carrying out emulsification and kneading of a raw material mixture in one step is disclosed. In the method, hollow microspheres and a mixture of an aqueous solution of inorganic oxidizer, an oil and an emulsifier are separately supplied into a common passage of an emulsifying and kneading machine; the hollow microspheres and the mixture are emulsified and kneaded on the surface of a disc arranged on the downstream side of the disc, while rotating the disc; the emulsified and kneaded mixture is flowed down from the outer peripheral portion of the disc into a kneading room formed under the disc, while continuing the emulsification and kneading; the emulsified and kneaded mixture is fully emulsified and kneaded in the kneading room; and then the resulting water-in-oil emulsion explosive is taken out from the kneading room. The method is shorter and simpler in the production step, is more effective for energy saving, is higher in the safeness in the process control and is more practicable than conventional methods.

1 Claim, 3 Drawing Figures

METHOD OF PRODUCING WATER-IN-OIL EMULSION EXPLOSIVE

BACKGROUND OF THE INVENTION (1) Field of the Invention

The present invention relates to a method of producing water-in-oil emulsion explosive (hereinafter, referred to as W/O emulsion explosive), and more particularly to a method of producing W/O emulsion explosive commercially advantageously in a short operation time by carrying out concurrently emulsification and kneading in one step.

(2) Description of the Prior Art

It is generally desired to decrease the number of production steps as small as possible in the commercial production of W/O emulsion explosive in view of the safeness in the production and the quality control of the resulting explosive regardless of the continuous method and batch method.

U.S. Pat. No. 4,138,281 specification discloses a method of producing W/O emulsion explosive comprising aqueous solution of inorganic oxidizer, oil, emulsifier and hollow microspheres. This method comprises five steps as illustrated in FIG. 1, that is, a step for conditioning an aqueous solution of inorganic oxidizer, a step for conditioning a mixture of oil and emulsifier, a step for preparing W/O emulsion by mmixing the mixture of oil and emulsifier with the above described aqueous solution of inorganic oxidizer, a step for kneading the resulting W/O emulsion together with hollow microspheres, and a step for packing the resulting W/O emulsion explosive.

Therefore, conventional methods for producing W/O emulsion explosive comprising such large number of steps is not desirable as a commercial production method.

There have been attempted various methods to carry out the above described emulsifying step and kneading step in one step. However, when a solid component of hollow microspheres is added to a W/O emulsion, the emulsion is broken, or the hollow microspheres are broken, and hence the W/O emulsion can not maintain its homogeneously emulsified state, and the quality of the resulting W/O emulsion explosive, particularly the storage stability thereof is deteriorated. As the result, the W/O emulsion explosive deteriorates in its detonability at low temperature or in its explosion performance during its storage for a long period of time.

The inventors have diligently studied for a long period of time in order to overcome the above described drawbacks, and have found out a method capable of concurrently carrying out the emulsification and kneading. Further, the inventors have ascertained that a W/O emulsion explosive produced by the newly found method has exactly the same explosion performance as that of a W/O emulsion explosive produced by the above described conventional method, wherein emulsification and kneading are carried out in separate steps, and have accomplished the present invention.

SUMMARY OF THE INVENTION

The feature fo the present invention is the provision of a method of producing water-in-oil emulsion explosive, comprising a step for conditioning an aqueous solution of inorganic oxidizer, a step for conditioning an oil, an emulsifier, or a mixture of oil and emulsifier, a step for mixing the aqueous solution of inorganic oxidizer with the oil and the emulsifier, a step for emulsifying the resulting mixture, a step for kneading the resulting water-in-oil emulsion together with hollow microspheres, and a step for packing the resulting water-in-oil emulsion explosive, the improvement comprising said emulsifying step and said kneading step being carried out in one step, wherein the hollow microspheres, and the mixture of the aqueous solution of inorganic oxidizer, the oil and the emulsifier are separately supplied into a common passage; the hollow microspheres and the mixture of the aqueous solution of inorganic oxidizer, the oil and the emulsifier are emulsified and kneaded on the surface of a disc, which is arranged on the downstream side of the passage and has projections, while rotating the disc; the emulsified and kneaded mixture is flowed down from the outer peripheral portion of the disc into a kneading room formed under the disc, while continuing the emulsification and kneading; the emulsified and kneaded mixture is fully emulsified and kneaded in the kneading room; and then the resulting water-in-oil emulsion explosive is taken out from the kneading room.

DESCRIPTION OF THE PREFERRED EMBODIMENT

Figure 1:
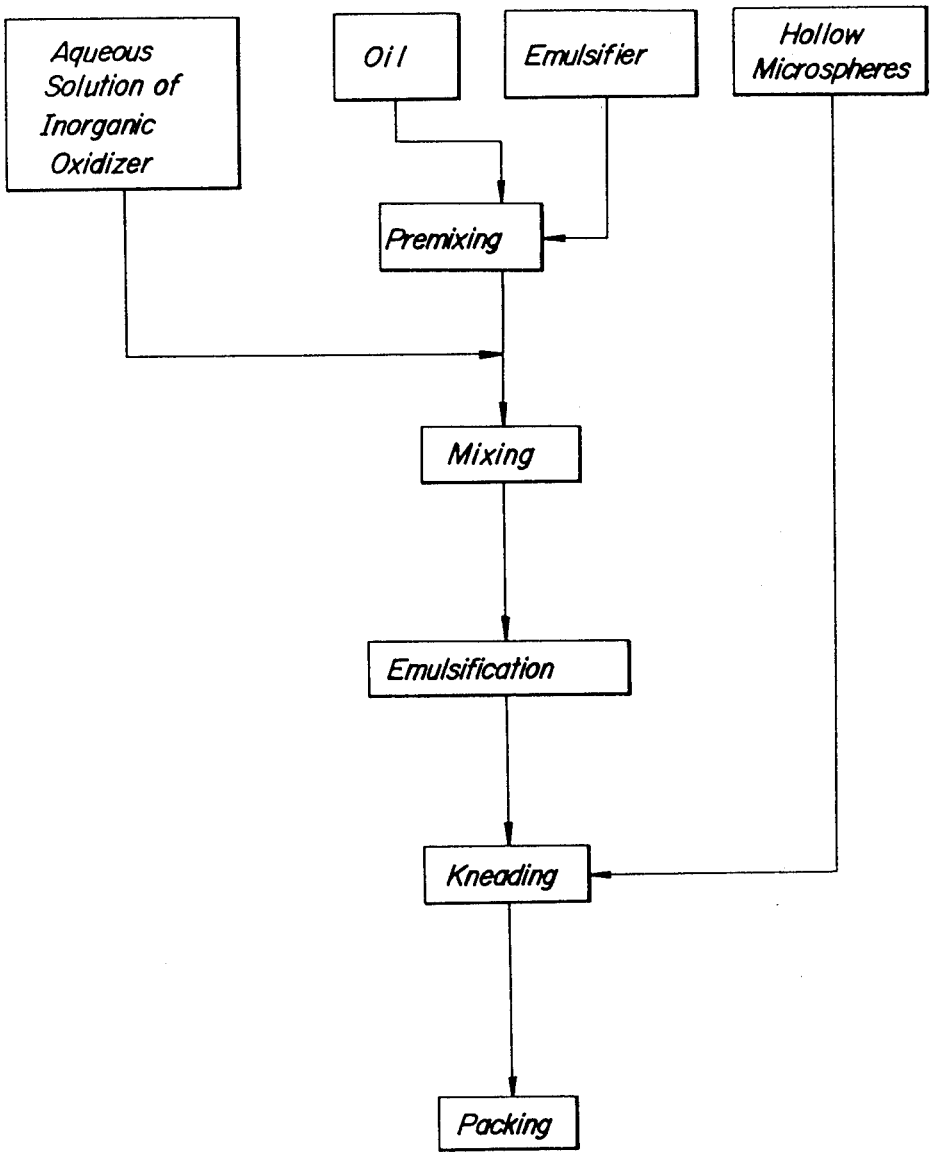
FIG. 1 is a flow sheet illustrating a conventional method of producing W/O emulsion explosive.

As the aqueous solution of inorganic oxidizer to be used in the present invention, there can be used an aqueous solution of ammonium nitrate or an aqueous solution of a mixture of ammonium nitrate with the other inorganic oxidizer salt, such as nitrate, chlorate or the like of alkali metal or alkaline earth metal. The aqueous solution of inorganic oxidizer can occasionally contain an extinguishing agent, such as sodium nitrate or the like, or a stabilizer, such as polyhydric alcohol or the like.

The oils to be used in the present invention include fuel oil and wax. As the fuel oil, mention may be made of, for example, hydrocarbon and its derivatives, and the like. As the wax, mention may be made of, for example, wax derived from petroleum, mineral wax, animal wax, insect wax and the like. The amount of these fuel oils and waxes to be contained in the resulting W/O emulsion explosive can be freely selected depending upon the desired property of the explosive.

The emulsifiers to be used in the present invention include all emulsifiers which form W/O emulsion, for example, sorbitan mono-, di-, tri- or sequi- fatty acid ester, mono- or di- glyceride of fatty acid, oxazoline derivative, imidazoline derivative and the like.

The hollow microspheres to be used in the present invention include inorganic hollow microspheres, such as glass, alumina, shirasu (shirasu is a kind of volcanic ash) and the like; carbonaceous hollow microspheres, such as pitch and the like; and synthetic resin hollow microspheres, such as phenolic resin and the like.

The compounding recipe of the above described components is generally and preferably that 75–98.8%

(in weight basis, hereinafter "%" means % by weight) of an aqueous solution of inorganic oxidizer, 0.1–10% of an oil, 0.1–5% of an emulsifier, and 1–10% of hollow microspheres.

Hereinafter, the present invention will be explained in more detail referring to the drawings.

Figure 2:
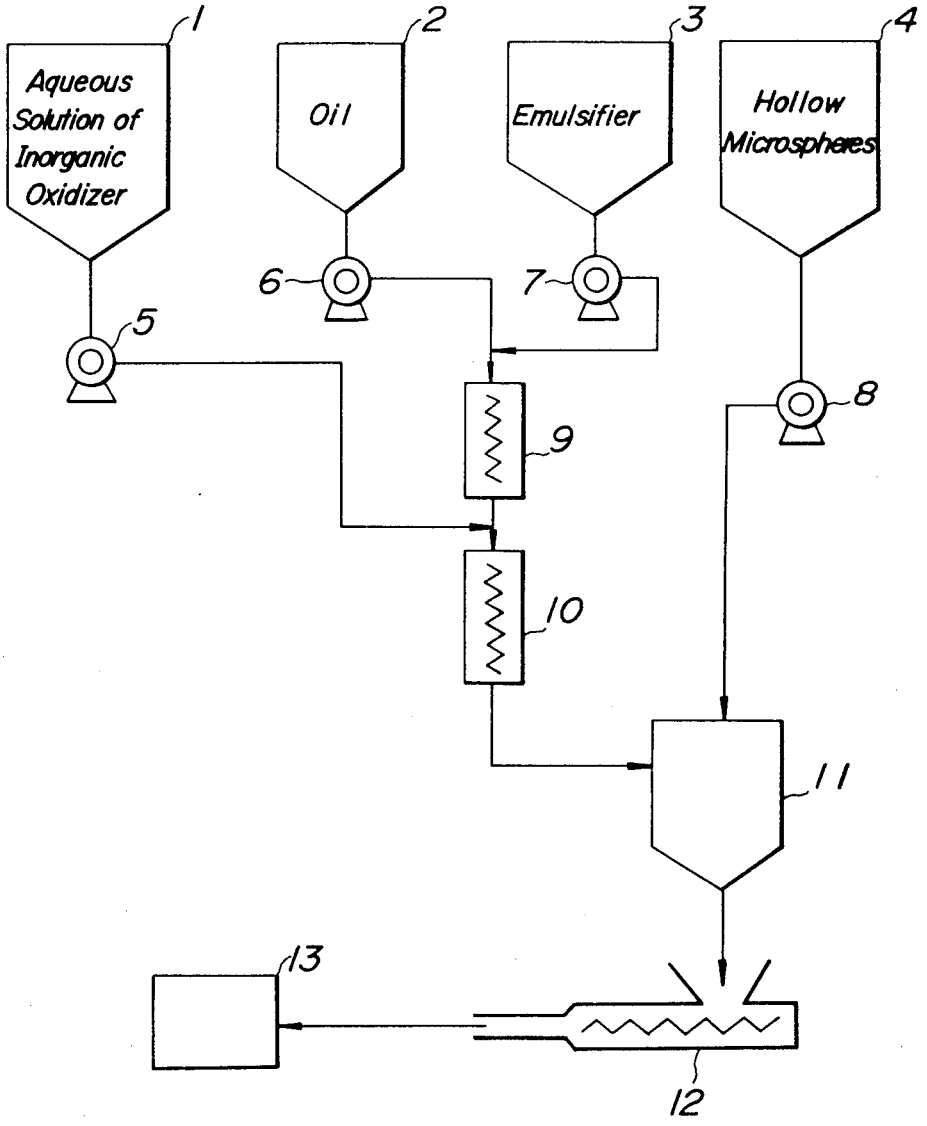
FIG. 2 is a flow sheet illustrating one embodiment of the method of the present invention for producing W/O emulsion explosive.
Figure 3:
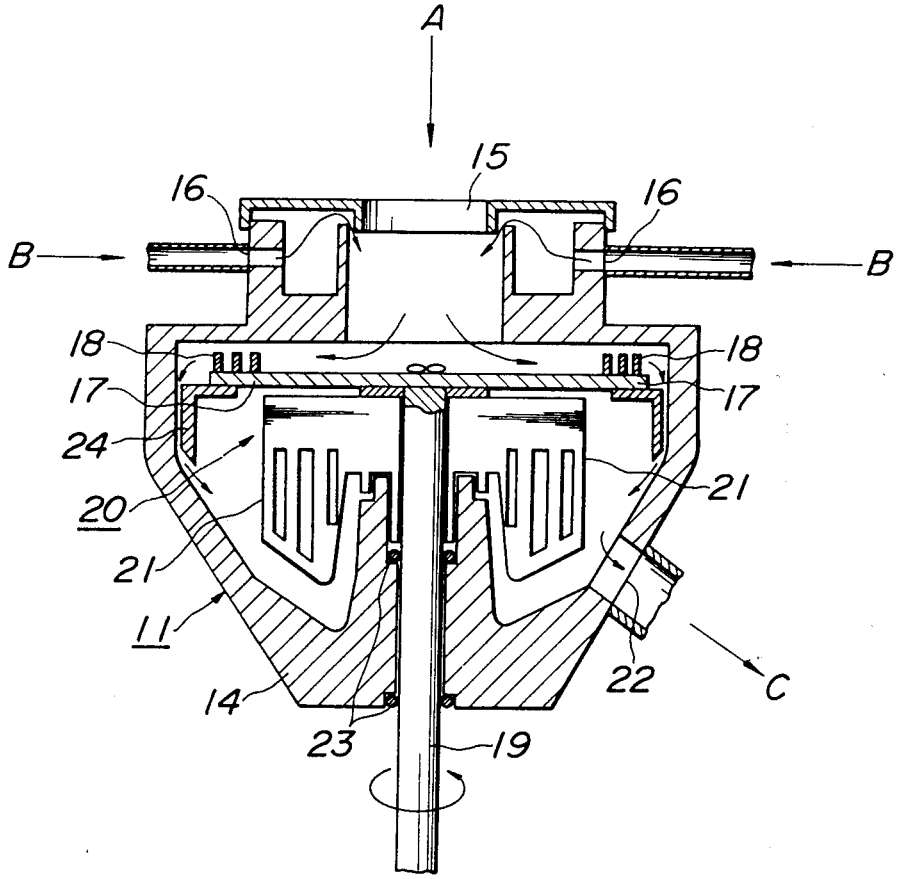
FIG. 3 is a vertical sectional view of one embodiment of an emulsifying and kneading machine used in the emulsifying and kneading step in the present invention.

FIG. 2 is a flow sheet illustrating one embodiment of the method of the present invention for producing W/O emulsion explosive; and FIG. 3 is a vertical sectional view of one embodiment of an emulsifying and kneading machine to be used in the emulsifying and kneading step in the present invention.

Referring to FIG. 2, an aqueous solution of inorganic oxidizer is kept at a temperature (generally 70°–130° C.) not less than the crystallization temperature of the inorganic oxidizer in a tank 1 for aqueous solution of oxidizer; an oil and an emulsifier are heated and kept at about 70°–100° C. in an oil tank 2 and in a melting tank 3, respectively; and hollow microspheres are kept in a feeder 4 for powdery material.

The oil and emulsifier heated to the above described temperature are quantitatively fed into a static mixer 9 by means of metering pumps 6 and 7 respectively, and mixed therein to form a mixture of the oil and the emulsifier. Then, the mixture is fed into a second static mixer 10. At the same time, the aqueous solution of inorganic oxidizer heated up to the above described temperature is quantitatively fed into the static mixer 10 by means of a metering pump 5, and is premixed therein with the above described mixture of oil and emulsifier. Then, the mixture is fed into an emulsifying and kneading machine 11 and emulsified therein. At the same time with the emulsification, hollow microspheres are quantitatively fed into the emulsifying and kneading machine 11 by means of a metering pump 8 and are emulsified and kneaded therein together with the emulsion of the aqueous solution of inorganic oxidizer, the oil and the emulsifier to form a W/O emulsion explosive composition. The resulting W/O emulsion explosive composition is fed into a packing machine 13 by means of a pump 12 (for example, screw pump), and a W/O emulsion explosive is produced therein.

FIG. 3 illustrates one embodiment of an emulsifying and kneading machine which can be advantageously used for carrying out the emulsifying and kneading step, which is a characteristic step to the present invention.

Referring to FIG. 3, a emulsifying and kneading machine 11 is mainly constituted with a vessel 14 having a supply hole 15 for powdery material, a supply hole 16 for liquid and an exhaust hole 22; a disc 17 fixed to the upper end of a rotating axis 19, having projections 18 arranged on its upper surface at its peripheral portion, and further having scraping blades 24 arranged on its lower surface at its peripheral portion; and a rotating blade 21 fixed to the rotating axis 19 and arranged in a kneading room 20 formed under the disc 17. The numeral 23 represents a sealing material.

Hollow microspheres are supplied from a feeder 4 for powdery material (FIG. 2) into an emulsifying and kneading machine 11 from A direction by means of a metering pump 8 (FIG. 2). While, a liquid mixture formed by mixing an aqueous solution of inorganic oxidizer with an oil and an emulsifier in a static mixer 10 is supplied into the emulsifying and kneading machine 11 from B direction. The disc 17 is rotated at a given rotation number of 100–5,000 rpm. The above described hollow microspheres and liquid mixture, which are dropped on the disc 17, are instantaneously splashed on the disc to the vicinity of the wall of the machine 11 by the action of centrifugal force and collided against a large number of column-like projections 18 fixed to the disc 17, and are concurrently emulsified and kneaded. Subsequently, the emulsified and kneaded mixture is flowed from the other peripheral portion of the disc 17 into the kneading room 20 formed under the disc 17, further fully emulsified and kneaded therein by means of a rotating blade 21, and then taken out from the kneading room 20 through an exhaust hole 22. When the diameter of the exhaust hole 22 is changed, the residence time of the emulsified and kneaded mixture in the machine can be varied, whereby the emulsified and kneaded state can be adjusted to any desired state.

As described above, the method of the present invention for producing W/O emulsion explosive is shorter by one production step than conventional production methods, can decrease the number of operators and can save the construction and maintenance costs of the plant. Therefore, the method of the present invention for producing W/O emulsion explosion is commercially advantageous.

The method of the present invention for producing W/O emulsion explosive will be explained referring to an example and a comparative example.

COMPARATIVE EXAMPLE

W/O emulsion explosives were produced through the steps illustrated in FIG. 1 according to the following method.

Into a tank of 2,000 l capacity were charged 900 kg of ammonium nitrate, 50 kg of sodiumm chlorate and 100 kg of water, and the resulting mixture was heated to preparee an aqueous solution of inorganic oxidizer kept at 90° C. Into another tank of 200 l capacity were charged 20.1 kg of an emulsifier and 40.2 kg of paraffin, and the resulting mixture was heated, melted and premixed to prepare a liquid mixture kept at 90° C.

The above obtained aqueous solution of inorganic oxidizer was fed into a static mixer at a flow rate of 18.0 kg/min by means of a plunger pump. At the same time, the above obtained liquid mixture was fed into the static mixer at a flow rate of 1.03 kg/min by means of a plunger pump to form a mixture of the aqueous solution of inorganic oxidizer and the liquid mixture therein. The mixture flowed out from the static mixer was fed into the bottom portion of an emulsifier provided in its interior with a homogenizer of 10 l capacity, and emulsified therein at a rotation number of 6,500 rpm (peripheral speed: 17 m/sec) to obtain a W/O emulsion.

The resulting W/O emulsion was fed into a kneader, and at the same time glass hollow microspheres are fed into the kneader at a flow rate of 380 g/min, and the resulting mixture was continuously kneaded at a rotation number of 180 rpm. After the kneading, the resulting W/O emulsion explosive composition was fed into a tube packing machine by means of a pump, and packed into two kinds of cartridges, one of which had a diameter of 25 mm (100 g) and the other of which had a diameter of 50 mm (1 kg), whereby W/O emulsion explosives were produced.

The resulting W/O emulsion explosives were measured just after the production and one year after the production with respect to the density, the detonation velocity at 20° C. by means of a No. 6 electric blasting cap under an unconfined state, and the lowest detonation temperature (low temperature detonability).

The obtained results are shown in the following Table 1.

EXAMPLE

W/O emulsion explosives were produced through the steps illustrated in FIG. 2 according to the following method. The kind and amount of the raw materials used in this Example are the same as those used in the Comparative example.

An aqueous solution of inorganic oxidizer was prepared in a tank 1 and kept at 90° C. Paraffin and an emulsifier, both kept at 90° C., were fed into a static mixer 9 by means of metering pumps 6 and 7 respectively, and mixed therein. When, the mixture of the paraffin and the emulsifier, flowed out from the static mixer 9, was fed into a second static mixer 10 at a flow rate of 1.03 kg/min, and at the same time the above prepared aqueous solution of inorganic oxidizer was fed into the static mixer 10 at a flow rate of 18.0 kg/min by means of a metering pump 5. A mixture of the aqueous solution of inorganic oxidizer, the paraffin and the emulsifier, flowed out from the static mixer 10, was continuously fed into an emulsifying and kneading machine 11 of 5 l capacity, and at the same time glass hollow microspheres were fed into the emulsifying and kneading machine 11 at a flow rate of 380 kg/min through its supply hole 15 for powdery material by means of a metering pump 8. The disc 17 of the emulsifying and kneading machine 11 was rotated at a rate of 700 rpm (peripheral speed: 10 m/sec). After the emulsification and kneading, the resulting W/O emulsion explosive composition was fed into a packing machine 13 (tube packing machine) by means of a pump 12 (screw pump), and packed into two kinds of cartridges, one of which had a diameter of 25 mm (100 g) and the other of which had a diameter of 50 mm (1 kg), whereby W/O emulsion explosives were produced.

The resulting two kinds of W/O emulsion explosives were subjected to the same tests as described in the Comparative example. The obtained results as shown in Table 1.

TABLE 1

| Test item | Example | | | Comparative Example | |
|---|---|---|---|---|---|
| | cartridge diameter (mm) | | | | |
| | 25ϕ | 50ϕ | | 25ϕ | 50ϕ |
| Just after the production | Density | 1.19 | 1.21 | 1.20 | 1.22 |
| | Detonation velocity at 20° C. (m/sec) | 5,020 | 5,490 | 4,930 | 5,560 |
| | Low temperature detonability (°C.) | −35 | −35 | −35 | −35 |
| One year after the production | Density | 1.21 | 1.22 | 1.21 | 1.20 |
| | Detonation velocity at 20° C. (m/sec) | 4,930 | 5,330 | 4,860 | 5,310 |
| | Low temperature detonability (°C.) | −25 | −25 | −20 | −25 |

It can be seen from the above Table 1 that the W/O emulsion explosive produced according to the method of the present invention, wherein emulsification and kneading are carried out in one step, has substantially the same performance as that of the W/O emulsion explosive produced by a conventional method, wherein emulsification and kneading are carried out in separate steps. Accordingly, the method of the present invention has various merits over conventional methods. That is, the method of the present invention is shorter and simpler in the production step, is more effective for energy saving, is easier in the process control, is higher in the safeness and is more practicable than conventional methods.

We claim:

1. In a method of producing water-in-oil emulsion explosive, comprising a step for conditioning an aqueous solution of inorganic oxidizer, a step for conditioning an oil, an emulsifier, or a mixture of oil and emulsifier, a step for mixing the aqueous solution of inorganic oxidizer with the oil and the emulsifier, a step for emulsifying the resulting mixture, a step for kneading the resulting water-in-oil emulsion together with hollow microspheres, and a step for packing the resulting water-in-oil emulsion explosive, the improvement comprising said emulsifying step and said kneading step being carried out in one step, wherein the hollow microspheres, and the mixture of the aqueous solution of inorganic oxidizer, the oil and the emulsifier are separately supplied into a common passage; the hollow microspheres and the mixture of the aqueous solution of inorganic oxidixer, the oil and the emulsifier are emulsified and kneaded on the surface of a disc, which is arranged on the downstream side of the passage and has projection, while rotating the disc; the emulsified and kneaded mixture is flowed down from the outer peripheral portion of the disc into a kneading room formed under the disc, while continuing the emulsification and kneading; the emulsified and kneaded mixture is fully emulsified and kneaded in the kneading room; and then the resulting water-in-oil emulsion explosive is taken out from the kneading room.

* * * * *